US007451743B2

(12) United States Patent
Heine et al.

(10) Patent No.: US 7,451,743 B2
(45) Date of Patent: Nov. 18, 2008

(54) FUEL INJECTION SYSTEM WITH ACCUMULATOR FILL VALVE ASSEMBLY

(75) Inventors: Frank Heine, Grand Rapids, MI (US); Brent Keppy, Grand Rapids, MI (US)

(73) Assignee: Robert Bosch GmbH, Stuttgart (DE)

( * ) Notice: Subject to any disclaimer, the term of this patent is extended or adjusted under 35 U.S.C. 154(b) by 73 days.

(21) Appl. No.: 10/548,511

(22) PCT Filed: Nov. 14, 2003

(86) PCT No.: PCT/US03/36773

§ 371 (c)(1),
(2), (4) Date: Sep. 6, 2005

(87) PCT Pub. No.: WO2004/079183

PCT Pub. Date: Sep. 16, 2004

(65) Prior Publication Data

US 2006/0180124 A1 Aug. 17, 2006

(51) Int. Cl.
*F02M 37/04* (2006.01)

(52) U.S. Cl. ..... 123/447; 123/446

(58) Field of Classification Search ..... 123/179.17, 123/456, 447, 446, 467, 500, 501
See application file for complete search history.

(56) References Cited

U.S. PATENT DOCUMENTS

| | | | | |
|---|---|---|---|---|
| 5,622,152 | A * | 4/1997 | Ishida | 123/446 |
| 5,732,679 | A * | 3/1998 | Takahasi et al. | 123/467 |
| 5,771,865 | A * | 6/1998 | Ishida | 123/467 |
| 6,112,721 | A * | 9/2000 | Kouketsu et al. | 123/447 |
| 6,450,146 | B1 | 9/2002 | Dickerson et al. | |
| 6,520,152 | B1 * | 2/2003 | Mahr et al. | 123/447 |
| 6,672,279 | B2 * | 1/2004 | Nakayama et al. | 123/299 |
| 6,763,809 | B2 * | 7/2004 | Grabandt | 123/467 |
| 6,874,476 | B2 * | 4/2005 | Brenk et al. | 123/467 |
| 6,877,483 | B2 * | 4/2005 | Askew | 123/467 |

FOREIGN PATENT DOCUMENTS

| | | | |
|---|---|---|---|
| DE | 101 22 242 | A1 | 11/2002 |
| EP | 0 976 925 | A2 | 2/2000 |
| EP | 1 199 467 | A2 | 4/2002 |
| EP | 1 275 842 | A1 | 1/2003 |

* cited by examiner

*Primary Examiner*—Carl S. Miller
(74) *Attorney, Agent, or Firm*—McGarry Bair PC

(57) ABSTRACT

A fuel injection system (10) having an accumulator (24) includes an accumulator fill valve assembly (20) that regulates pressure within the accumulator (24) for operation of injection events other than the main injection. A restriction (128) in an inlet conduit and a stepped surface in a spool valve (112) provide a pressure amplifier across the accumulator valve.

22 Claims, 6 Drawing Sheets

FUEL INJECTION SYSTEM WITH ACCUMULATOR FILL VALVE ASSEMBLY

CROSS-REFERENCE TO RELATED APPLICATIONS

This application claims priority on International Application No. PCT/US03/36773, filed Nov. 14, 2003.

BACKGROUND OF THE INVENTION

1. Field of the Invention

This invention relates to pump systems for fuel injection systems.

2. Description of the Related Art

Engine exhaust emission regulations are becoming increasingly restrictive. One way to meet emission standards is to precisely control the quantity and timing of the fuel injected into the combustion chamber to match the engine cycle. For certain engine operating conditions, effective injection rate shaping may result in reduced levels of particulates and oxides of nitrogen in the engine exhaust. Such rate shaping may comprise multiple injection events including early pilot, close pilot and early and late post injection in addition to shaping the main injection event.

Some existing rate shaping techniques attempt to control injection rates by making various modifications to the injector nozzle assembly. Another rate shaping technique utilizes a separate control valve to provide more precise rate shaping than with modified injector nozzle assemblies. An example of such a control valve is disclosed in U.S. Pat. No. 6,276,610 to Spoolstra et al.

Fuel injection systems that utilize one or more control valves in unit pumps or unit injectors typically have cam driven pumps that provide good pressure capability, smooth beginning of injection characteristics, compact size and lower cost. However, among the disadvantages of unit pumps or unit injectors are design constraints imposed by the cam, and complexity in valve design and valve actuation.

Another rate shaping technique utilizes a common rail system where high-pressure fuel is stored in a common rail and injection events are controlled by a single needle control valve in each injector. Common rail systems are highly effective for multiple injection events, yet they too have some disadvantages. Common rail systems typically have a large number of high-pressure connections that increase opportunities for leakage. Also, the distance between the rail and the injector nozzle results in pressure waves that inhibit repeatable valve behavior.

One proposed solution is disclosed in DE 199 63 219 where an accumulator is provided between the pump and the injector for each cylinder. One problem with this solution, however, is that pressure in the accumulator is still constrained by the design of the cam and no direct controls are provided to regulate the pressure in the accumulator.

SUMMARY OF THE INVENTION

The foregoing problems are solved by the present invention of a fuel injection system of the type having a pump system including a plunger in a pumping chamber, and an injector having a nozzle that can be opened and closed by a control valve wherein an injection event will occur when the control valve is actuated and will not occur when the control valve is not actuated. An accumulator is fluidly connected between the pump system and the injector to store pressurized fuel for injection events independent of the pump system. Typically, a fuel supply will provide fuel to the pump system and to the injector by way of the accumulator. According to the invention, an accumulator fill valve assembly is mounted in fluid communication with the accumulator and is operable between an open condition and a closed condition. Thus, in the open condition, the accumulator is in fluid communication with the pumping chamber and in the closed condition, the accumulator is not in fluid communication with the pumping chamber.

Preferably, the accumulator fill valve assembly comprises a spool, one portion of which is in fluid communication with the fuel supply, and another portion of which is in fluid communication with the accumulator. When pressure in the accumulator exceeds a set point, the spool will be moved against pressure in the fuel supply to the open condition.

In one aspect of the invention, pressure in the fuel supply is adjustable, and adjusting the fuel supply pressure will also adjust the set point. In another aspect of the invention the spool is biased against pressure in the accumulator by a spring. Alternatively, the spool has a portion in fluid communication with the pumping chamber wherein pressure in the pumping chamber biases the spool against pressure in the accumulator.

Preferably, the accumulator fill valve assembly has an inlet conduit in fluid communication with the pumping chamber and a restriction in the inlet conduit. The restriction establishes a pressure drop between the pumping chamber and accumulator. This pressure drop serves both to add to a pressure amplification between supply pressure and accumulator pressure, as well as to assist in fill valve positioning with flow induced forces. In this case, the accumulator valve further comprises a stepped valve element. Also, preferably, the injector has a nozzle needle control chamber, and a conduit extends between the accumulator fill valve assembly and the nozzle needle control chamber.

DESCRIPTION OF THE PREFERRED EMBODIMENTS

Figure 1:
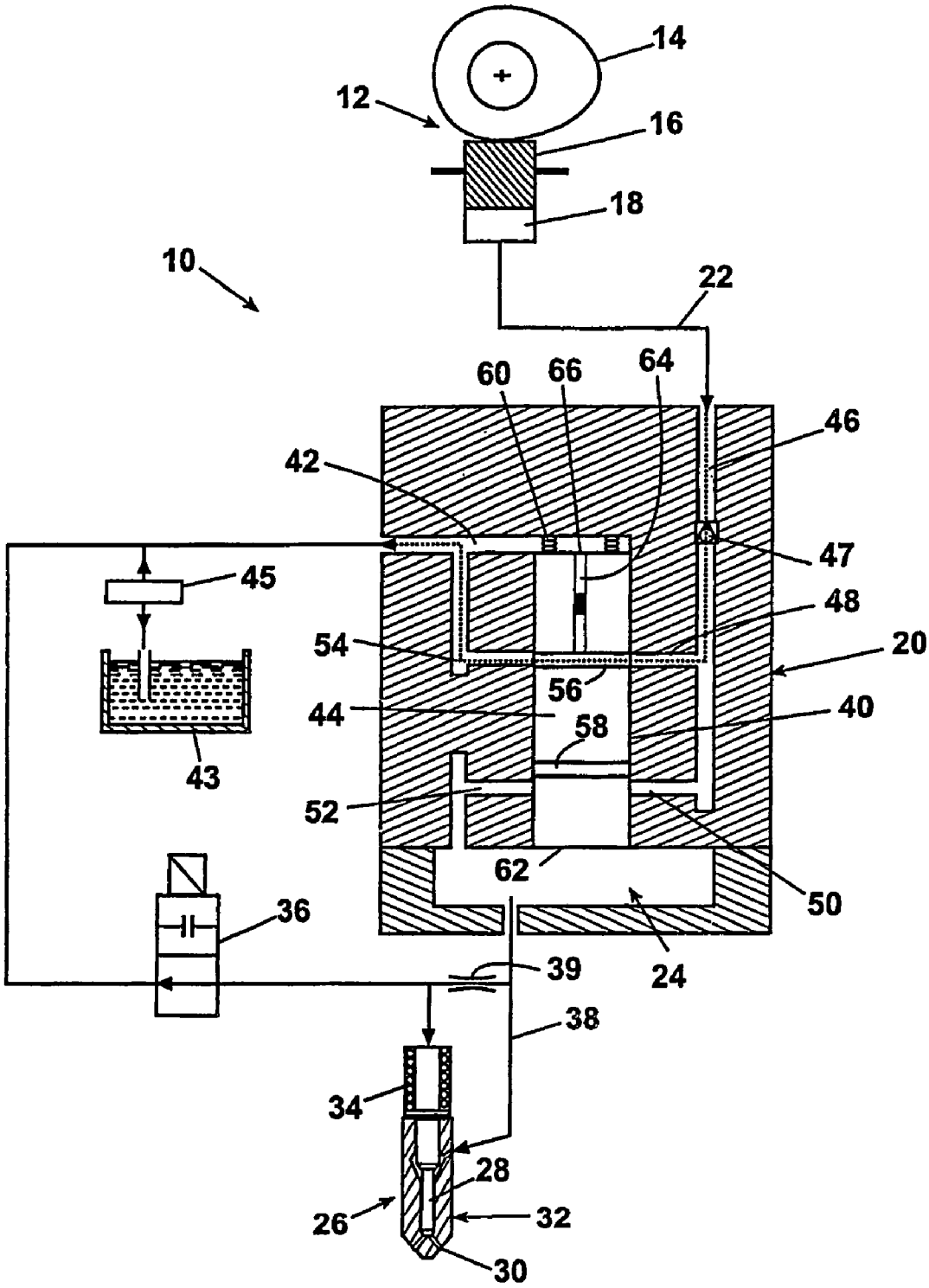
FIG. 1 is a schematic diagram of a fuel injection system with an accumulator fill valve assembly according to the invention in the closed position.
Figure 2:
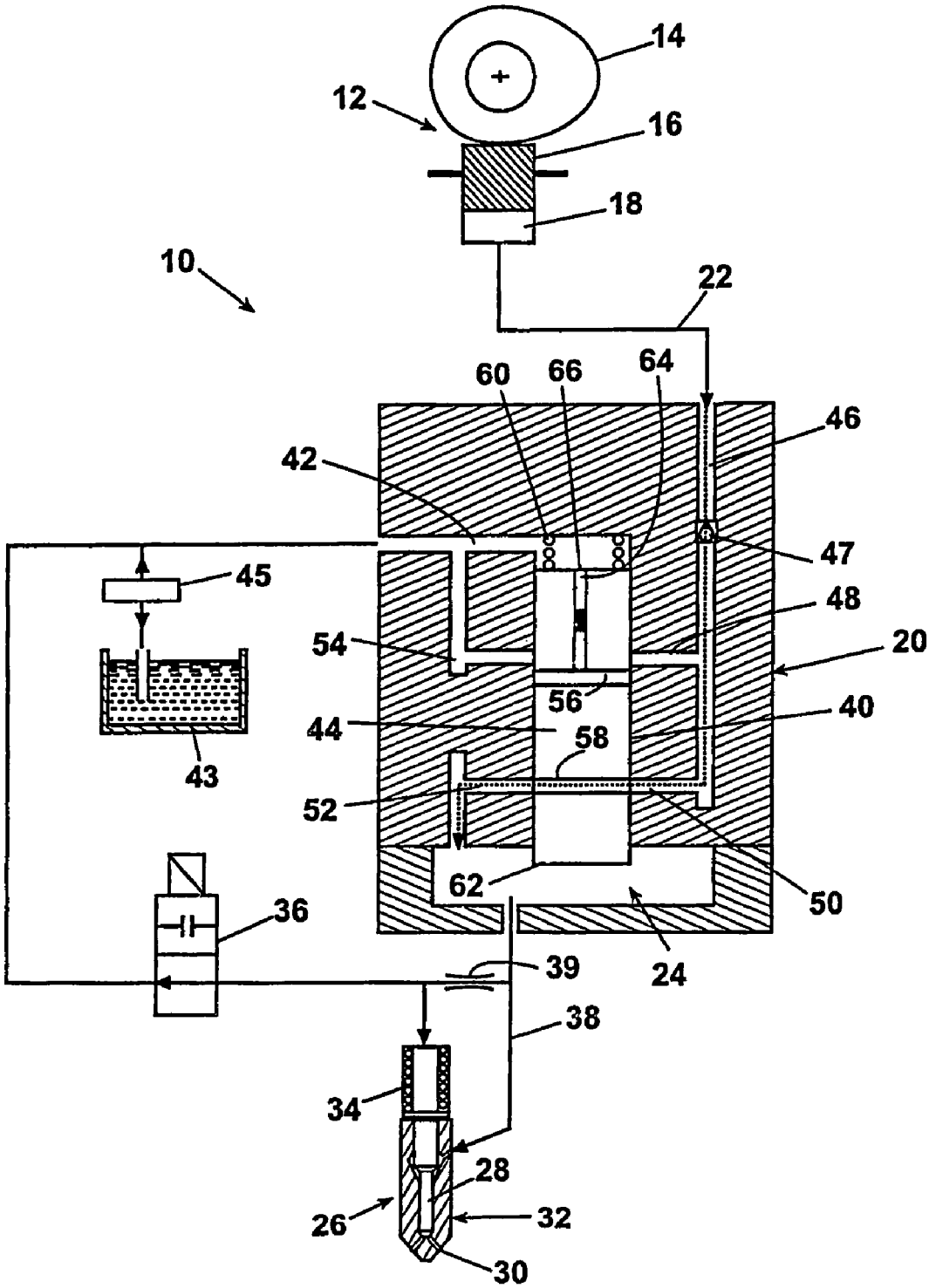
FIG. 2 is a schematic diagram of a fuel injection system with an accumulator fill valve assembly according to the invention in the open position.

A fuel injection system incorporating the invention is generally indicated schematically at 10, in FIGS. 1 and 2. A pump system 12 includes an engine driven cam 14 that drives a plunger 16 in a pumping chamber 18. The pumping chamber 18 is connected to an accumulator fill valve assembly 20 via a high-pressure fluid line 22. The accumulator fill valve assembly 20 is fluidly connected to an accumulator 24, which in turn is fluidly connected to an injector 26. It will be understood that the pump system 12 may be a unit pump connected via a high-pressure fluid line to the injector 26, or alternatively, may be incorporated into a unit injector. Further, it is appreciated that there are many different ways to implement the present invention in accordance with the schematic illustrations in FIGS. 1 and 2.

The injector 26 has a needle 28 that is biased to close spray holes 30 in a nozzle 32 by a combination of a spring 34 and fluid pressure. Means are provided to control injection events in the injector 26. Here, a nozzle needle control valve 36 is disposed in fluid communication with the top of the nozzle 32. The injector is fluidly connected to the accumulator 20 by a high-pressure fuel line 38. Also, an inlet throttle 39 upstream of the top of the nozzle 32 and fluidly connected to the high-pressure fuel line helps to control injection events, and especially proper and timely closure of the needle 28.

A fuel injection event is triggered by actuating the nozzle needle control valve 36, which normally occurs electronically. Actuation causes a pressure differential across the needle 28 that lifts the needle, and initiates the injection event. It will be appreciated that other means are known in the art to control injection events. The particular manner of injection control is not critical to the invention.

Looking now more closely at the accumulator fill valve assembly 20 and the accumulator 24, it can be seen that they are modular in that they are directly mounted to each other with the accumulator 24 open to the accumulator fill valve assembly 20. The accumulator fill valve assembly 20 has an internal bore 40, which is open at one end to the accumulator 24 and at the other end to a fuel supply conduit 42. The fuel supply conduit 42 communicates with a fuel supply 43, and the nozzle needle control valve 36 also communicates with the fuel supply 43 in conventional manner. A spool valve 44 reciprocates in the internal bore 40. An inlet conduit 46 is in fluid communication with the high-pressure fluid line 22. A one-way check valve 47 prevents flow reversal in the inlet conduit 46. First and second connecting conduits 48, 50 fluidly connect the inlet conduit 46 to the internal bore 40. An accumulator supply conduit 52 has at least a portion coaxial with the second connecting conduit 50, and extends between the internal bore 40, opposite the second connecting conduit 50, and the accumulator 24. A fuel supply connecting conduit 54 has at least a portion thereof slightly offset from the axis of the first connecting conduit 48, and extends between the internal bore 40, opposite the first connecting conduit 48, and the fuel supply conduit 42.

The spool valve 44 has a first transverse passage 56 and a second transverse passage 58. The first transverse passage 56 is disposed to establish communication between the first connecting conduit 48 and the fuel supply connecting conduit 54. The second transverse passage 58 is disposed to establish fluid communication between the second connecting conduit 50 and the accumulator supply conduit 52. The passages 56, 58 are disposed so that when one establishes communication, the other will not. A spring 60 biases the spool valve 44 so that one end 62 thereof is urged toward the accumulator 24. An antilock orifice 64 extends between the first transverse passage 56 and the other end 66, which is in fluid communication with the fuel supply conduit 42. The antilock orifice 64 is intended to avoid a hydraulic lock of the spool valve 44.

It will be apparent that the position of the spool valve 44 in the internal bore 40 depends upon the force of the spring 60, the pressure in the fuel supply conduit 42, the pressure in the pumping chamber 18 (as communicated to the high-pressure fluid line 22, the inlet conduit 46 and the first and second connecting conduits 48, 50), and the pressure in the accumulator 24. The cross-sectional area of the one end 62 determines the force exerted on the spool valve 44 by pressure in the accumulator 24. The force is counteracted by the force of the spring 60 and pressure in the fuel supply conduit 42. A set point of accumulator pressure can thus be adjusted by controlling fuel supply pressure. Fuel supply pressure is controlled by pressure regulator 45, which in a conventional manner would comprise a fuel pressure circuit, control valve, or other pressure regulation means.

The accumulator fill valve assembly 20 is illustrated in the closed position in FIG. 1 and in the open position in FIG. 2. In the closed position, the transverse passage 56 establishes fluid communication between the first connecting conduit 48 and the fuel supply connecting conduit 54. Meanwhile, fluid communication between the second connecting conduit 50 and the accumulator conduit 52 is blocked. In the open position, the transverse passage 58 establishes fluid communication between the second connecting conduit 50 and the accumulator conduit 52. Meanwhile, fluid communication between the first connecting conduit 48 and the fuel supply pressure conduit 54 and the fuel supply line 42 is blocked.

At the beginning of an injection cycle, the accumulator fill valve assembly 20 will normally be open because pressure in the accumulator 24 will normally be below the set point. As the cam 14 rotates and the plunger 16 moves, fuel is pumped into the high-pressure fluid line 22, the inlet conduit 46, the second connecting conduit 50, the second transverse passage 58, the accumulator connecting conduit 52 to the accumulator 24 and the high-pressure fuel line 38. Because the injector 26 is closed, pressure builds in the accumulator 24 until it reaches the set point. When the accumulator set point is reached, the force exerted on the spool valve 44 overcomes the counteracting forces of the spring 60 and the pressure in fuel supply line 42, and the accumulator fill valve assembly 20 closes to the position shown in FIG. 1.

When the nozzle needle control valve 36 initiates main injection, fuel is released from the accumulator 24 and high-pressure line 38 through the nozzle 32. As pressure in the accumulator 24 drops below the set point, the accumulator fill valve assembly 20 reopens, establishing direct fluid communication between the pumping chamber 18 and the injector nozzle 32. In this mode, injection proceeds in a conventional manner.

When injection is terminated by deactivating the nozzle needle control valve 36, pressure again builds in the accumulator 24 (so long as the plunger 16 is still advancing into the pumping chamber 18) until it exceeds the accumulator set point and closes the accumulator fill valve assembly 20. At this point, the stored fuel in the accumulator 24 is available at high-pressure for auxiliary injection events other than main injection. Importantly, these injection events can occur independently of the position of the cam 14 because the accumulator 24 is cut off from fluid communication with the pumping chamber 18. Activating and deactivating the nozzle needle control valve 36 can then accomplish control of auxiliary injection events.

For example, a post injection event is triggered by actuating the nozzle needle control valve 36, which opens the nozzle 32 and releases fuel from the accumulator 24, independent of the position of the cam 14. Simply closing the nozzle needle control valve 36 ends the post injection event. Moreover, control of injection pressure during any injection event can be achieved by adjusting the fuel supply pressure, thereby adjusting the accumulator set point of the accumulator 24. For example, if injection pressure is desired to be lower as in a light load engine operation, a pressure regulator valve in the engine's fuel supply circuit can lower the fuel supply pressure, thereby lowering the accumulator set point above which the accumulator fill valve assembly 24 will close.

Figure 3:
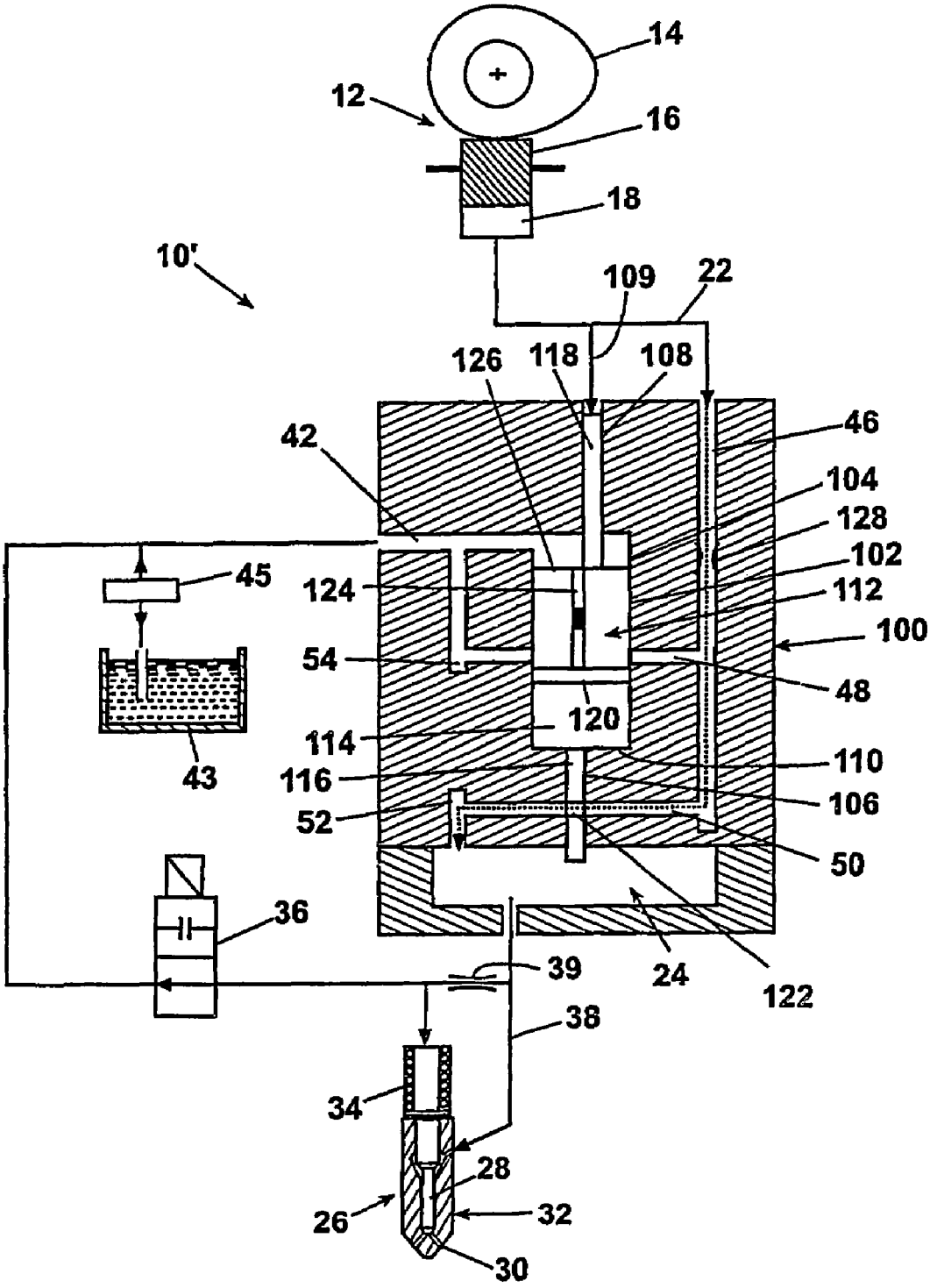
FIG. 3 is a schematic diagram of a fuel injection system with an alternate embodiment of an accumulator fill valve assembly according to the invention in the open position.
Figure 4:
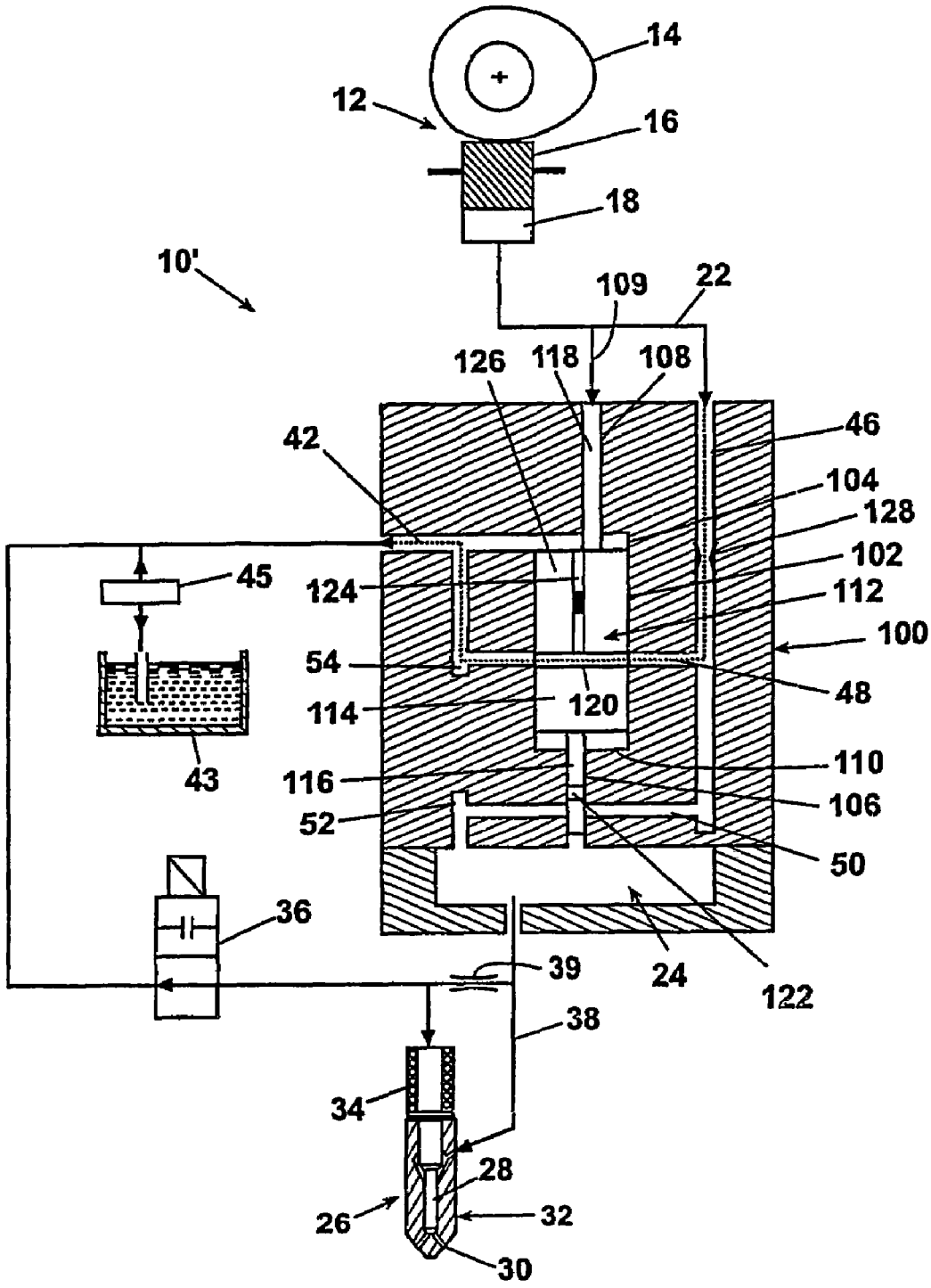
FIG. 4 is a schematic diagram of a fuel injection system with an alternate embodiment of an accumulator fill valve assembly according to the invention in the closed position.

FIGS. 3 and 4 illustrate an alternative embodiment 10' of a fuel injection system with an accumulator valve according to the invention that obviates any need for springs or a check valve. In the embodiment of FIGS. 3 and 4, components common to the embodiment of FIGS. 1 and 2 bear like reference numerals. An accumulator fill valve assembly 100 has a body comprising stepped internal bore 102 with a larger diameter portion 104, a smaller diameter portion 106 and a load portion 108. One step is defined by a shoulder 110 between the larger diameter portion 104 and the smaller diameter portion 106. The larger diameter portion 104 communicates with the fuel supply conduit 42. The load portion 108 extends from the larger diameter portion 104 to communicate with the high-pressure fluid line 22 via load line 109.

A spool valve 112 comprise a medial spool 114 that reciprocates within the larger diameter portion 104 of the internal bore, a pressure pin 116 that extends into the smaller diameter portion 106, and a load pin 118 that extends into the load portion 108. A first transverse passage 120 in the spool 112 (here in the medial spool 114) is disposed to establish communication between the first connecting conduit 48 and the fuel supply connecting conduit 54. A second transverse passage 122 in the spool 112 (here in the pressure pin 116) is disposed to establish fluid communication between the second connecting conduit 50 and the accumulator supply conduit 52. The passages 120, 122 are disposed so that when one establishes communication, the other will not.

An antilock orifice 124 extends between the first transverse passage 120 and one end 126 of the medial spool 114, which is in fluid communication with the fuel supply conduit 42. The antilock orifice 124 is intended to avoid a hydraulic lock of the spool valve 112. A step surface 127 at the other end of the medial spool 114 abuts the shoulder 110 when the accumulator 24 is below the set point. The shoulder 110 is vented (not shown) to permit the medial spool 114 to reciprocate without drawing a vacuum in the larger diameter portion 104 between the step surface 127 and the shoulder 110.

A restriction 128 is disposed in the inlet conduit 46 between the high-pressure fluid line 22 and the first connecting conduit 48. Operation of the accumulator fill valve assembly 100 is the same as explained above with respect to the embodiment of FIGS. 1 and 2, except that the restriction 128, along with the pressure on the spool 112 and the load pin 118, creates a pressure drop that achieves a self-enhancing pressure amplification across the accumulator fill valve assembly. The amplification ratio is determined by the relative sizes of the pressure pin 116, the medial spool 114 and the load pin 118. In this case, pressure in the accumulator 24 acts on the pressure pin 116 to generate a force that is counteracted by the pressure in the high pressure load line 109 acting on the load pin 118 plus the pressure of the fuel supply acting on the end 126 of the medial spool 114. The size of the restriction 128 need only be sufficient to create a pressure differential large enough to move the mass of the spool valve 112. Preferably, there will be a high amplification ratio from the fuel supply side of the spool valve 112 to the accumulator side.

Figure 5:
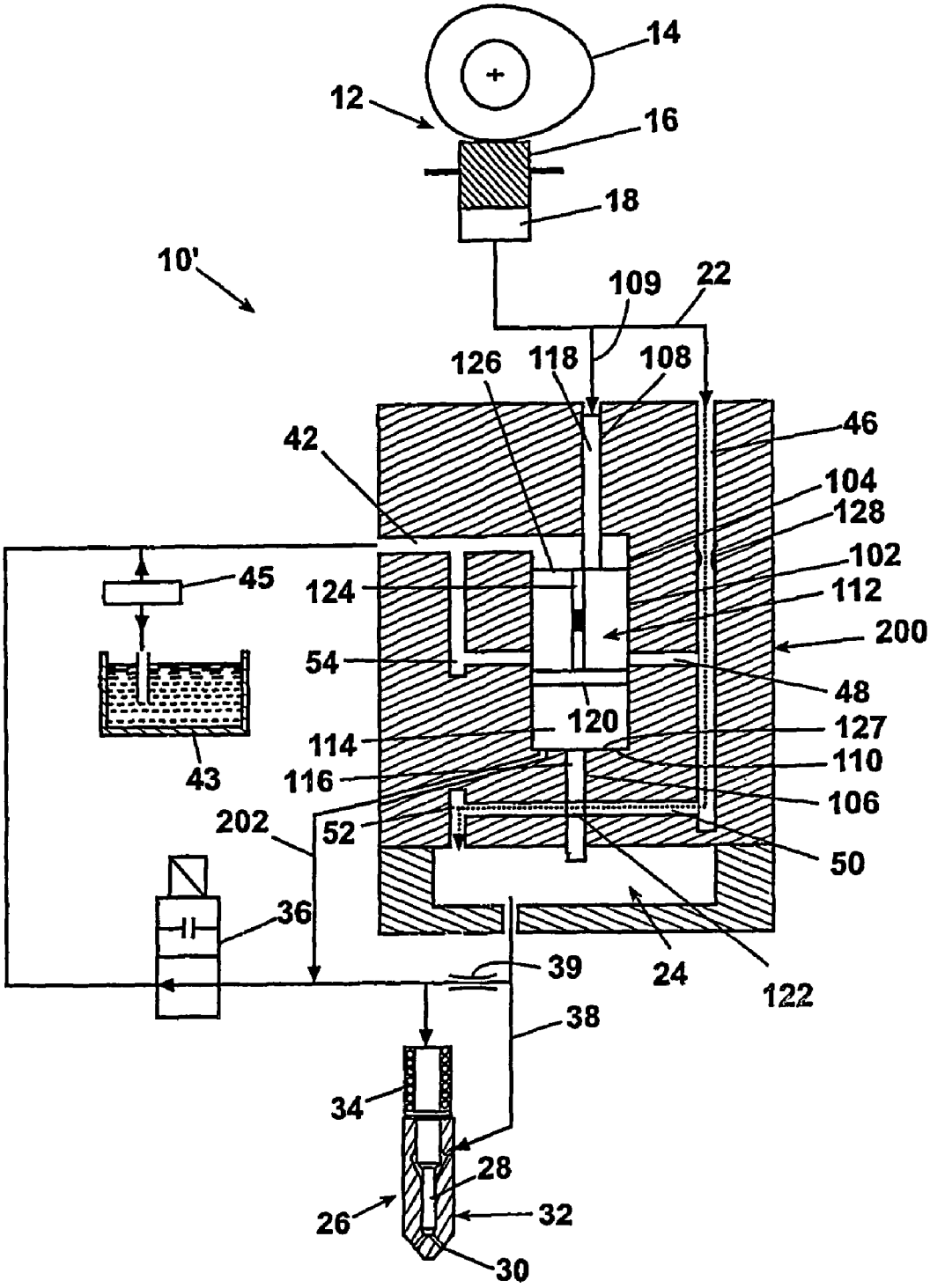
FIG. 5 is a schematic diagram of a fuel injection system with a third embodiment of an accumulator fill valve assembly according to the invention in the open position.
Figure 6:
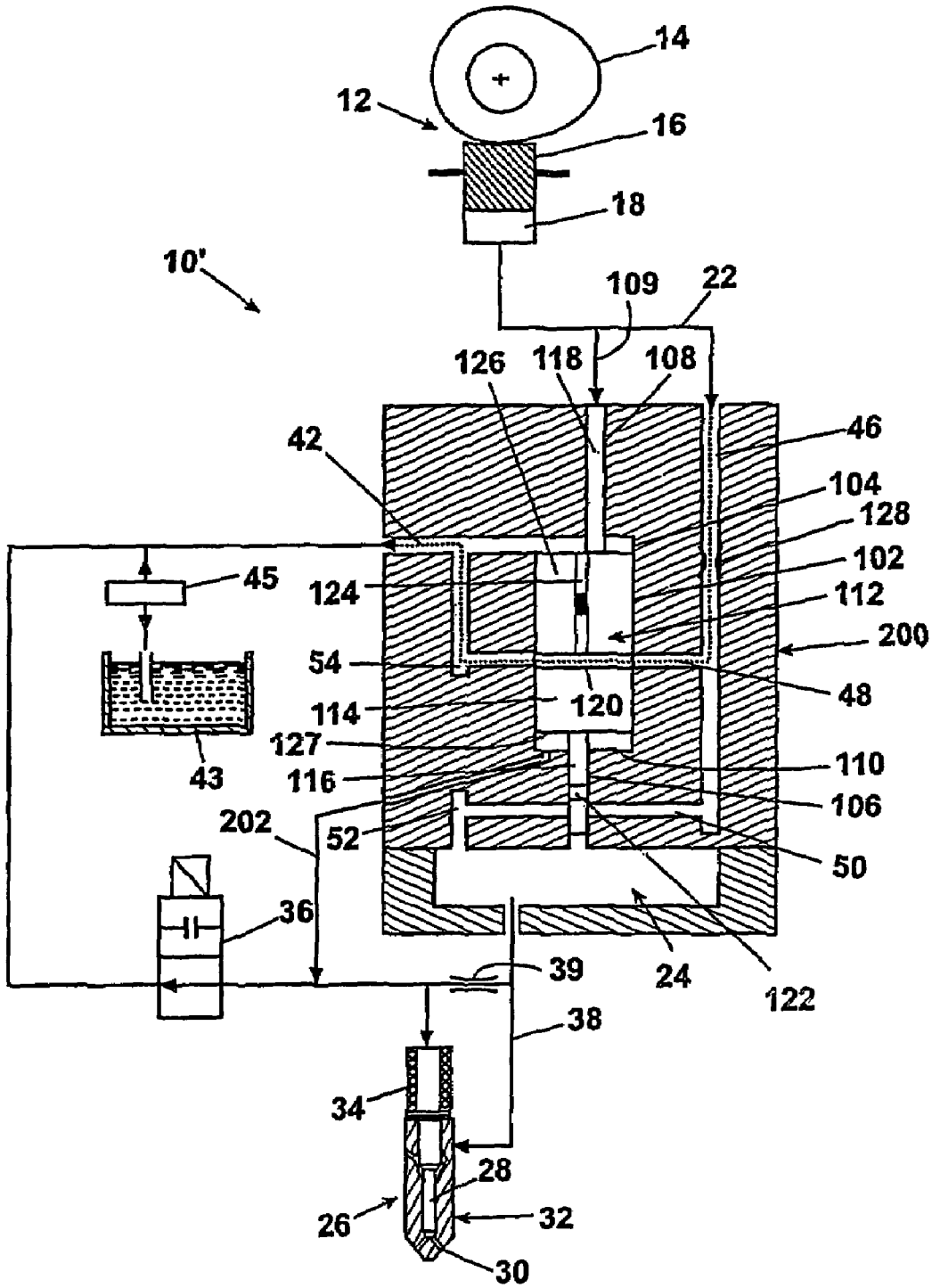
FIG. 6 is a schematic diagram of a fuel injection system with a third embodiment of an accumulator fill valve assembly according to the invention in the closed position.

It is appreciated that upon opening the nozzle needle control valve 36 to commence main injection, for example, a sudden pressure drop in the accumulator 24 due to the open nozzle 32 may cause the nozzle to reclose, partially or fully, while pressure is building up in the accumulator 24. An undesirable "dip" in the rate of injection would result In order to ensure that the accumulator fill valve assembly will preemptively open only when the nozzle needle control valve 36 is actuated and when the plunger 16 is advancing, the embodiment of FIGS. 5 and 6 provides an alternate accumulator fill valve assembly 200 that is identical in every respect to that of FIGS. 3 and 4, except that a pressure conduit 202 extends between the top of the nozzle 32 and the shoulder 110. Thus, pressurized fuel in the pressure conduit 202 will generate a force on the step surface 127 of the medial spool 114. Here, when the nozzle needle control valve 36 is closed, pressure in the accumulator 24 acts on the pressure pin 116 and also on the step surface 127 so that the accumulator fill valve assembly 200 will remain open until the accumulator pressure reaches the accumulator set point. In FIG. 6, the accumulator fill valve assembly 200 is closed and will remain closed as long as the nozzle needle control valve 36 is not actuated because the accumulator pressure exceeds the accumulator set point. But when the nozzle needle control valve 36 is actuated, the accumulator fill valve assembly 200 will open quickly and remain open as long as the plunger 16 is advancing while the nozzle needle control valve 36 is actuated.

While the invention has been specifically described in connection with certain specific embodiments thereof, it is to be understood that this is by way of illustration and not of limitation, and the scope of the appended claims should be construed as broadly as the prior art will permit.

We claim:

1. A unit fuel injector comprising:

a pump including a plunger in a pumping chamber;

a nozzle that can be opened and closed by a control valve, wherein an injection event will occur when the control valve is actuated and will not occur when the control valve is not actuated;

an accumulator fluidly connected between the pump and the nozzle to store pressurized fuel at high pressure for injection events independent of the pump;

a fuel supply for supplying fuel to the pump and to the nozzle by way of the accumulator; and an accumulator fill valve assembly mounted between the pump and the nozzle in high pressure fluid communication with the accumulator and operable between an open condition and a closed condition, wherein the accumulator fill valve assembly comprises a spool, one portion of which is in fluid communication with the fuel supply, and another portion of which is in fluid communication with the accumulator, whereby in the open condition, the accumulator is in fluid communication with the pumping chamber and in the closed condition, the accumulator is not in fluid communication with the pumping chamber and when pressure in the accumulator exceeds a set point the spool will be moved against pressure in the fuel supply to the closed condition.

2. A unit fuel injector according to claim 1 wherein pressure in the fuel supply is adjustable and adjusting the fuel supply pressure will adjust a set point, above which the accumulator fill valve assembly will close.

3. A unit fuel injector according to claim 1 wherein the spool is biased against pressure in the accumulator by a spring.

4. A unit fuel injector according to claim 1 wherein the spool has a portion in fluid communication with the pumping chamber and wherein pressure in the pumping chamber biases the spool against pressure in the accumulator.

5. A unit fuel injector according to claim 1 where the spool has different diameters to establish an amplification ratio across the accumulator fill valve assembly.

6. A unit fuel injector comprising:

a pump including a plunger in a pumping chamber;

a nozzle that can be opened and closed by a control valve, wherein an injection event will occur when the control valve is actuated and will not occur when the control valve is not actuated;

an accumulator fluidly connected between the pump and the nozzle to store pressurize fuel at high pressure for injection events independent of the pump;

a fuel supply for supplying fuel to the pump and to the nozzle by way of the accumulator; and an accumulator fill valve assembly mounted between the pump and the nozzle in high pressure fluid communication with the accumulator and operable between an open condition and a closed condition, wherein the accumulator fill valve assembly has an inlet conduit in fluid communication with the pumping chamber and a restriction in the inlet conduit to establish a self enhanced pressure amplifier across the accumulator valve.

7. A unit fuel injector according to claim 6 further comprising a stepped valve element.

8. A unit fuel injector according to claim 6 further comprising a conduit extending between the accumulator fill valve assembly and the top of the nozzle.

9. A unit fuel injector according to claim 2 wherein the spool is biased against pressure in the accumulator by a spring.

10. A unit fuel injector according to claim 2 wherein the spool has a portion in fluid communication with the pumping chamber and wherein pressure in the pumping chamber biases the spool against pressure in the accumulator.

11. A unit fuel injector according to claim 2 where the spool has different diameters to establish an amplification ratio across the accumulator fill valve assembly.

12. A unit fuel injector according to claim 3 where the spool has different diameters to establish an amplification ratio across the accumulator fill valve assembly.

13. A unit fuel injector according to claim 4 where the spool has different diameters to establish an amplification ratio across the accumulator fill valve assembly.

14. A unit fuel injector according to claim 1 wherein the accumulator fill valve assembly has an inlet conduit in fluid communication with the pumping chamber and a restriction in the inlet conduit to establish a self enhanced pressure amplifier across the accumulator valve.

15. A unit fuel injector according to claim 2 wherein the accumulator fill valve assembly has an inlet conduit in fluid communication with the pumping chamber and a restriction in the inlet conduit to establish a self enhanced pressure amplifier across the accumulator valve.

16. A unit fuel injector according to claim 3 wherein the accumulator fill valve assembly has an inlet conduit in fluid communication with the pumping chamber and a restriction in the inlet conduit to establish a self enhanced pressure amplifier across the accumulator valve.

17. A unit fuel injector according to claim 1 further comprising a conduit extending between the accumulator fill valve assembly and the top of the nozzle.

18. A unit fuel injector according to claim 2 further comprising a conduit extending between the accumulator fill valve assembly and the top of the nozzle.

19. A unit fuel injector according to claim 3 further comprising a conduit extending between the accumulator fill valve assembly and the top of the nozzle.

20. A fuel injection system comprising:

a pump system including a plunger in a pumping chamber;

an injector having a nozzle that can be opened and closed by a control valve, wherein an injection event will occur when the control valve is actuated and will not occur when the control valve is not actuated;

an accumulator fluidly connected between the pump system and the injector to store pressurized fuel at high pressure for injection events independent of the pump system; and a fuel supply for supplying fuel to the pump system and to the injector by way of the accumulator;

characterized by:

an accumulator fill valve assembly mounted between the pump system and the injector in high pressure fluid communication with the accumulator and operable between an open condition and a closed condition, wherein the accumulator fill valve assembly comprises a spool, one portion of which is in fluid communication with the fuel supply, and another portion of which is in fluid communication with the accumulator, and the accumulator fill valve assembly has an inlet conduit in fluid communication with the pumping chamber and a restriction in the inlet conduit to establish a self enhanced pressure amplifier across the accumulator valve, whereby in the open condition, the accumulator is in fluid communication with the pumping chamber and in the closed condition, the accumulator is not in fluid communication with the pumping chamber and when pressure in the accumulator exceeds a set point the spool will be moved against pressure in the fuel supply to the closed condition.

21. A fuel injection system comprising:

a pump system including a plunger in a pumping chamber;

an injector having a nozzle that can be opened and closed by a control valve, wherein an injection event will occur when the control valve is actuated and will not occur when the control valve is not actuated;

an accumulator fluidly connected between the pump system and the injector to store pressurized fuel at high pressure for injection events independent of the pump system; and a fuel supply for supplying fuel to the pump system and to the injector by way of the accumulator;

characterized by:

an accumulator fill valve assembly mounted between the pump system and the injector in high pressure fluid communication with the accumulator and operable between an open condition and a closed condition, wherein the accumulator fill valve assembly comprises a spool, one portion of which is in fluid communication with the fuel supply, and another portion of which is in fluid communication with the accumulator, whereby in the open condition, the accumulator is in fluid communication with the pumping chamber and in the closed condition, the accumulator is not in fluid communication with the pumping chamber.

22. A fuel injection system comprising:

a pump system including a plunger in a pumping chamber;

an injector having a nozzle that can be opened and closed by a control valve, wherein an injection event will occur when the control valve is actuated and will not occur when the control valve is not actuated;

an accumulator fluidly connected between the pump system and the injector to store pressurized fuel at high pressure for injection events independent of the pump system; and a fuel supply for supplying fuel to the pump system and to the injector by way of the accumulator;

characterized by:

an accumulator fill valve assembly mounted between the pump system and the injector in high pressure fluid communication with the accumulator and operable between an open condition and a closed condition, wherein the accumulator fill valve assembly comprises a spool, one portion of which is in fluid communication with the fuel supply, and another portion of which is in fluid communication with the accumulator, and further comprising a conduit extending between the accumulator fill valve assembly and the top of the nozzle, whereby in the open condition, the accumulator is in fluid communication with the pumping chamber and in the closed condition, the accumulator is not in fluid communication with the pumping chamber.

* * * * *